United States Patent [19]

Nitta

[11] Patent Number: 4,784,601

[45] Date of Patent: Nov. 15, 1988

[54] GAS LIGHTER EQUIPPED WITH A SAFETY LOCK

[75] Inventor: Tomio Nitta, Yokohama, Japan

[73] Assignee: Tokai Corporation, Kanagawa, Japan

[21] Appl. No.: 146,158

[22] Filed: Jan. 20, 1988

[30] Foreign Application Priority Data

Mar. 9, 1987 [JP] Japan ..... 62-33123[U]

[51] Int. Cl.[4] ..... F23D 11/36

[52] U.S. Cl. ..... 431/153; 431/277; 222/153; 222/402.11; 251/95; 251/106

[58] Field of Search ..... 431/254, 277, 267, 131, 431/153, 253; 251/95, 319, 102, 106; 222/153, 402.11, 384

[56] References Cited

U.S. PATENT DOCUMENTS

| | | | |
|---|---|---|---|
| 3,749,286 | 7/1973 | Douglas | 222/153 |
| 3,792,800 | 2/1974 | Capra et al. | 222/153 X |
| 3,938,943 | 2/1976 | Malamoud | 431/150 |
| 4,424,920 | 1/1984 | Tada | 222/402.11 |
| 4,432,542 | 2/1984 | Poynter | 431/254 X |
| 4,679,712 | 7/1987 | Foster et al. | 222/402.11 X |

*Primary Examiner*—Randall L. Green

*Attorney, Agent, or Firm*—Armstrong, Nikaido, Marmelstein & Kubovcik

[57] ABSTRACT

Disclosed is a gas lighter equipped with a safety lock, which is an L-shaped slidable stopper so slidably fitted in the reentrancy of the thumb-push gas lever that its vertical leg may be on the top of the lighter housing when its horizontal leg is pushed in the reentrancy of the gas lever, thus preventing the descent of the gas lever for lighting, and that its vertical leg may be off from the top surface of the lighter housing when its horizontal leg is drawn to the full length, thus permitting the descent of the gas lever for lighting. A gas lighter according to the present invention assures in its locking condition that an accident which may be caused when a child plays with the device, such as a burn or an accidental fire is prevented.

3 Claims, 1 Drawing Sheet

GAS LIGHTER EQUIPPED WITH A SAFETY LOCK

BACKGROUND OF THE INVENTION

1. Field of the Invention

The present invention relates to a gas lighter equipped with a safety lock.

2. Related Arts

A conventional gas lighter is operated by pushing down its gas lever for ejecting gas and at the same time by rotating its striker wheel for striking fire and igniting the ejected gas, thereby permitting a small flame to shoot out. Such gas lighter is very easy to handle, and even a child can use the device. Therefore, there is a fear of a child getting burnt while playing with a gas lighter, and also there is a fear of a fire breaking out.

SUMMARY OF THE INVENTION

The object of the present invention is to provide a gas lighter equipped with a safety lock, thereby guaranteed free of such fears as described above.

To attain this object a gas lighter comprising a housing having a gas well contained therein, a gas valve fixed to the inside of the housing and communicating with the gas well, a gas ejection nozzle connected to the gas valve and fixed to the top of the housing, a fire-striking wheel rotatably fixed to the top of the housing in the vicinity of the gas ejection nozzle, a thumb-operated gas lever movably fixed to the top of the housing in the vicinity of the fire-striking wheel and operatively connected to the gas valve, the thumb-operated gas lever being responsive to thumb-push for descending and opening the valve, thereby permitting the ejection of gas from the gas ejection nozzle, and a windshield fixed to the top of the housing and surrounding the gas ejection nozzle, is improved according to the present invention in that: there is provided a safety lock in the form of slidable L-shaped stopper, one leg of which is slidably connected to the gas lever; the other leg of the stopper being on the top of the housing when the stopper is put in an inward position in which the stopper is relatively near the windshield, thus preventing the descent of the gas lever, and the other leg of the stopper being off from the top surface of the housing when the stopper is put in an outward position in which the stopper is relatively remote from the windshield, thus permitting the descent of the gas lever.

Other objects and advantages of the present invention will be better understood from the following description of a gas lighter according to one embodiment of the present invention, which is shown in the accompanying drawings:

PREFERRED EMBODIMENT OF THE INVENTION

Figure 1:
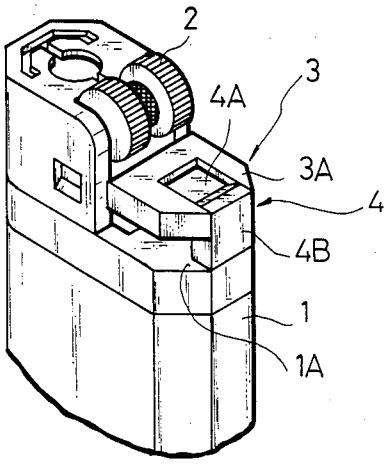
FIG. 1 is a perspective view of a gas lighter equipped with a safety lock according to the present invention.
Figure 5:
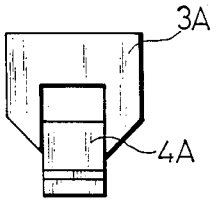
FIG. 5 is a plan view of the slidable L-shaped stopper in its unlocking condition.
Figure 4:
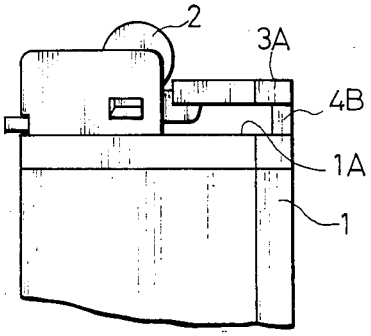
FIG. 4 is a side view of the gas lighter in its locking condition.
Figure 6:
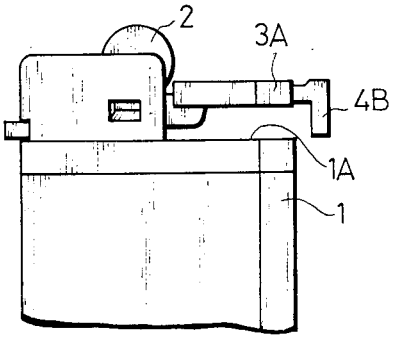
FIG. 6 is a side view of the gas lighter in its unlocking condition.

Referring to the drawings, a gas lighter comprises a housing 1 which contains a gas well, a gas valve communicating with the gas well and other necessary parts. A gas ejection nozzle (not shown) is connected to the gas valve and fixed to the top of the housing 1. A fire-striking wheel 2 is rotatably fixed to the top of the housing 1 in the vicinity of the gas ejection nozzle. A thumb-operated gas lever 3 is movably fixed to the top of the housing 1 in the vicinity of the fire-striking wheel 2. One end of the gas lever 3 is connected to the gas valve for permitting the ejection of gas from the gas ejection nozzle, and the other end of the gas lever 3 is made in the form of thumbpush piece 3A. The thumb-operated gas lever 3 is responsive to thumb-push for descending and opening the gas valve, thereby permitting the ejection of gas from the gas ejection nozzle. A windshield is fixed to the top of the housing 1 to surround the gas ejection nozzle. A slidable L-shaped stopper 4 is attached to the thumb-push piece 3A. One leg 4A of the L-shaped stopper 4 is slidably connected to the thumb-push piece 3A of the gas lever 3, and the other leg 4B of the stopper 4 stands on the top of the housing 1 when the stopper 4 is put in an inward position in which the stopper 4 is relatively near the windshield (See FIGS. 1, 2 and 4). The other leg 4B of the stopper 4 is off from the top surface of the housing 1 when the stopper 4 is put in an outward position in which the stopper 4 is relatively remote from the windshield (See FIGS. 5 and 6).

Figure 2:
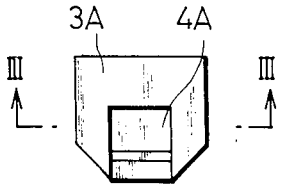
FIG. 2 is a plan view of the slidable L-shaped stopper in its locking condition.
Figure 3:
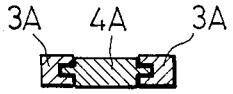
FIG. 3 is a cross section of the slidable L-shaped stopper taken along the line III—III and as seen from the direction indicated by arrows.

As best shown in FIG. 2 the thumb-push piece 3A has reentrancy opening on the side of gas lever opposite to the windshield. As best shown in FIG. 3, the reentrancy has slots made on its opposing side walls. One leg 4A of the slidable L-shaped stopper 4 has ridges on its opposite edges, and is slidably fitted in the reentrancy of the gas lever with the ridges of the opposite leg edges inserted in the slots of the reentrancy. Alternatively, the reentrancy may have ridges on its opposing side walls, and one leg 4A of the slidable L-shaped stopper may have slots made on its opposite leg edges.

With this arrangement the other leg 4B of the stopper 4 is on the top of the housing 1 when the stopper 4 is pushed in the reentrancy of the gas lever, thus preventing the descent of the gas lever for permitting a small fire to shoot out. The other leg 4B of the stopper 4 is off from the top surface of the housing 1 when the stopper 4 is drawn apart from the windshield, thus permitting the descent of the gas lever, and hence permitting a small fire to shoot out.

As may be understood from the above, a gas lighter according to the present invention assures in its locking condition that an accident which may be caused when a child plays with the device, such as a burn or and accidental fire is prevented.

What is claimed is:

1. A gas lighter comprising a housing having a gas well contained therein, a gas valve fixed to the inside of the housing and communicating with the gas well, a gas ejection nozzle connected to the gas valve and fixed to the top of the housing, a fire-striking wheel rotatably fixed to the top of the housing in the vicinity of the gas ejection nozzle, a thumb-operated gas lever movably fixed to the top of the housing in the vicinity of the fire-striking wheel and operatively connected to the gas valve, the thumb-operated gas lever being responsive to thumb-push for descending and opening the valve, thereby permitting the ejection of gas from the gas ejection nozzle, and a windshield fixed to the top of the housing and surrounding the gas ejection nozzle, characterized in that the gas lighter further comprises a slidable L-shaped stopper whose one leg is slidably connected to the gas lever; the other leg of the stopper being on the top of the housing when the stopper is put in an inward position in which the stopper is relatively near the windshield, thus preventing the descent of the gas lever, and the other leg of the stopper being off from the top surface of the housing when the stopper is put in an outward position in which the stopper is relatively remote from the windshield, thus permitting the descent of the gas lever.

2. A gas lighter as claimed in claim 1, wherein the thumb-operated gas lever has a reentrancy opening on the side of the gas lever opposite to the windshield, the reentrancy opening having slots made on its opposing side walls and one leg of the slidable L-shaped stopper having ridges on its opposite edges, and being slidably fitted in the reentrancy opening of the gas lever with the ridges of the opposite edges inserted in the slots of the reentrancy opening, whereby the other leg is on the top of the housing when the stopper is pushed in the reentrancy opening of the gas lever, thus preventing the descent of the gas lever, and the other leg is off from the top surface of the housing when the stopper is drawn apart from the windshield, thus permitting the descent of the gas lever.

3. A gas lighter as claimed in claim 1, wherein the thumb-operated gas lever has a reentrancy opening on the side of the gas lever opposite to the windshield, the reentrancy opening having ridges on its opposing side walls and one leg of the slidable L-shaped stopper has slots made on its opposite leg edges, said one leg being slidably fitted in the reentrancy opening of the gas lever with the ridges of the opposing side walls of the reentrancy opening inserted in the slots of the one leg, whereby the other leg is on the top of the housing when the stopper is pushed in the reentrancy opening of the gas lever, thus preventing the descent of the gas lever, and the other leg is off from the top surface of the housing when the stopper is drawn apart from the windshield, thus permitting the descent of the gas lever.

* * * * *